United States Patent [19]

Clere

[11] 4,401,530

[45] Aug. 30, 1983

[54] ELECTRODE

[75] Inventor: Thomas M. Clere, Willowick, Ohio

[73] Assignee: Diamond Shamrock Corporation, Dallas, Tex.

[21] Appl. No.: 306,071

[22] Filed: Sep. 28, 1981

[51] Int. Cl.[3] ..... C25B 1/34; C25B 9/00

[52] U.S. Cl. ..... 204/98; 204/128; 204/284; 204/280

[58] Field of Search ..... 204/284, 280, 98, 128

[56] References Cited

U.S. PATENT DOCUMENTS

| | | | |
|---|---|---|---|
| 1,366,534 | 1/1921 | Hall | 204/284 |
| 3,123,545 | 3/1964 | Williams | 204/284 |
| 3,607,411 | 9/1971 | Brownrigg | 204/284 |
| 3,676,315 | 7/1972 | Goens et al. | 204/280 |
| 4,142,950 | 3/1979 | Creamer et al. | 204/284 |

OTHER PUBLICATIONS

Websters 7th New Collegiate Dictionary, p. 739.

*Primary Examiner*—R. L. Andrews
*Attorney, Agent, or Firm*—Bruce E. Harang

[57] ABSTRACT

A 3-dimensional electrode having substantially coplanar and substantially flat portions and ribbon-like curved portions, said curved portions being symmetrical and alternating in rows above and below said substantially coplanar, substantially flat portions, respectively, and a geometric configuration presenting in one sectional aspect the appearance of a series of ribbon-like oblate spheroids interrupted by said flat portions and in another sectional aspect, 90° from said one aspect, the appearance of a square wave pattern.

8 Claims, 9 Drawing Figures

ELECTRODE

BACKGROUND OF THE INVENTION

The electrolytic production of chlorine and caustic soda by the electrolysis of brine has been well-known for many years. Historically, diaphragm cells using a hydraulically-permeable asbestos diaphragm, vacuum deposited onto foraminous steel cathodes, have been widely commercialized. Such diaphragm cells, employing permeable diaphragms, produce sodium chloride-containing sodium hydroxide catholytes due to the fact that sodium chloride passes through the diaphragm from the anolyte to the catholyte. Such NaCl-containing caustic soda generally requires a de-salting process to obtain a low salt caustic for industrial purposes.

Another type of cell useful for chlorine production is the mercury cell which utilizes a mercury amalgam to remove the sodium. The amalgam is transported to another reactor site where the sodium is reacted with water to form alkali (sodium hydroxide). The electrodes of this invention are useful in mercury cells as they permit use of closer gap without causing shorting and permit more even current distribution than, e.g., the prior art diamond configuration.

More recently, the chlor-alkali industry has focused much attention on developing membrane cells to produce low salt or salt-free caustic in order to improve quality and avoid the costly de-salting procedures. Membranes have been developed for that purpose which are substantially hydraulically-impermeable, but which will permit hydrated sodium ions to be transported from the anolyte portion to the catholyte portion, while substantially preventing transport of chloride ions. Such cells are operated by flowing a brine solution into the anolyte portion and by providing salt-free water to the catholyte portion to serve as the caustic medium. Hydrogen is evolved from the cathode and chlorine from the anode, regardless of whether a membrane cell or a diaphragm cell is employed.

Presently the cost of the electric power which is required to conduct the electrolytic dissociation for the production of chlor-alkali has risen dramatically. The rapid increase in the cost of electric power has in turn spurred a variety of efforts to find ways to lower the amount of electrical energy required to operate chlor-alkali electrolytic cells, thus reducing in turn the cost of the chlorine and caustic soda thereby produced.

Among the various approaches to reducing electric power required to operate electrolytic cells has been the development of the dimensionally stable anode. These anodes customarily are made from valve metal substrates, such as titanium, having a protective coating of a variety of precious or semiprecious metals or metal oxides, e.g., platinum oxide, cobalt spinel, etc. Other efforts have been aimed to reducing the gap or distance between the anode, the cathode and the separating membrane.

These efforts at improving the electrical efficiency of chlor-alkali cells, such as the dimensionally stable anodes, the narrowing in the gaps of electrolytic cells, and others have greatly improved electrical efficiency and utilization.

The present invention enables voltage savings enhanced utilization of the electric power in the chlor-alkali cell, by utilization of electrodes, either anodes, or cathodes, or both anodes and cathodes, having a particular geometric configuration. It is most surprising that the power requirement for conducting the electrolytic dissociation reaction present in a chlor-alkali cell can be improved by controlling the electrode geometry.

Prior to the present invention, it has been customary to utilize anodes of the expanded metal type. By "expanded metal" it is meant that such anodes are produced from metal sheets having varying gauges or thicknesses by cutting or stamping said sheet and then pulling the sheet either in a direction perpendicular to or parallel to the angle at which the cut or punch is made. Thus there have been produced unflattened and flattened expanded metal electrodes with varying shapes, such as diamond hexagonal, etc., when viewed from above (top plan view) and characteristic sectional (side) view configurations depending on the orientation of the section. Electrodes which are made by an expanded metal-type procedure are flatter than others and some, including unflattened electrodes, have fairly sharp edges, which can prove disadvantageous when closely contacting the comparatively delicate hydraulically impermeable membrane. Membranes currently in use are of the polymeric variety, e.g., the membrane material widely employed at present is that developed by the E.I. duPont de Nemours and Co. known in the art as "Nafion®." This material is a hydrolyzed copolymer of tetrafluoroethylene and a sulfonated perfluorovinyl ether such as is disclosed in U.S. Pat. No. 3,282,875. Demonstrative of unflattened, expanded metal electrodes are the cathodes 10 shown at FIGS. 1–3 in U.S. Pat. No. 4,142,950 to Creamer et al, also contained in an article entitled "Gas Diverting Electrodes in the Chlor-Alkali Membrane Cell" by Jacob Jorne et al appearing in the *J. Electrochem. Soc.: ELECTROCHEMICAL SCIENCE AND TECHNOLOGY,* February, 1980, as FIGS. 1 and 2. Of similar note is the unflattened electrode shown in plan and respective end views at FIGS. 4, 5 and 6 in U.S. Pat. No. 4,105,514 to Justice et al and described as a louvered mesh cathode. Such unflattened cathodes are typical of the prior art unflattened expanded metal electrodes shown in FIGS. 4–6 herein.

BRIEF SUMMARY OF THE INVENTION

Thus it is an object of this invention to achieve economies in chlor-alkali cell operation while avoiding membrane damage by using a novel electrode which is an integral, 3-dimensional electrode having substantially flat portions and curved ribbon-like portions, said curved ribbon-like portions being symmetrical and alternating in rows above and below said flat portions, respectively, and has a geometric configuration presenting in one sectional aspect (end view) the appearance of a series of oblate spheroids interrupted by said flat portions; and in another sectional aspect (end view) substantially 90° from said one aspect, the appearance of a square wave pattern. By use of the electrodes of the present invention in processes for electrochemical production of chlorine and caustic soda, particularly in membrane-type chlor-alkali cells, electric power savings of 5 percent, or even more, can be achieved. When it is kept in mind that the chlor-alkali industry utilizes tremendous amounts of electric power, savings of from 1 to 5 percent, or higher, constitute a marked economy in the production of chlorine and caustic soda.

DETAILED DESCRIPTION OF THE INVENTION

The present invention contemplates the use of an electrode(s) whose configuration results in a lower cell voltage when used in a membrane-type chlor-alkali cell for electrochemically producing chlorine and caustic soda by passing an electric current through an aqueous brine solution. The electrodes whose use is contemplated herein are produced by stamping or punching a metal sheet to yield an integral, 3-dimensional electrode having substantially flat portions and curved portions, said curved portions being symmetrical and alternating in rows above and below said flat portions, respectively. Said electrode has a geometric configuration which presents in one sectional aspect the appearance of a series of oblate spheroids interrupted by the flat portions and in another sectional aspect (substantially 90° from said first aspect) the appearance of a square wave pattern. In other words, from one side view (sectional view), the integral electrode of this invention gives the appearance of a series of football-shapd (oblate spheroid-shaped) ribbons interconnected by the substantially flat portions of the electrode sheet. Approximately half of the oblate spheroid is above the flat portions of the sheet and approximately half thereof is below the flat portions of the sheet. When the electrode of this invention is rotated 90° from the first sectional presentation, the curved portions constituting the upper and lower halves of the oblate spheroid-type ribbons constitute the upper and lower respective portions of the square wave pattern with the flat portions being intermediate between the upper and lower square waves. The configuration of the electrodes of this invention can be readily distinguished from that of the unflattened expanded metal prior art and the flattened expanded metal prior art by respectively comparing plan views 1, 4 and 7; sectional views 2, 5 and 8; and sectional views 3, 6 and 9.

Figure 1:
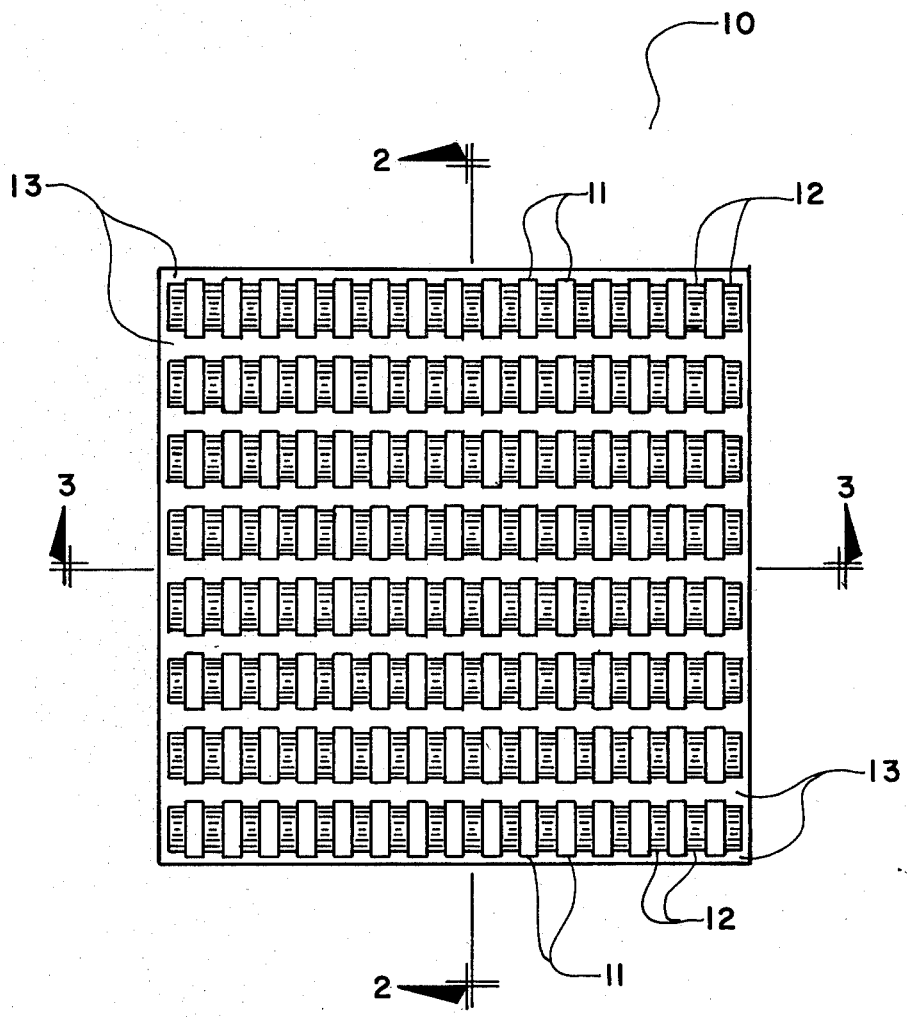
FIG. 1 is a top plan view of the electrode 10 of this invention.
Figure 2:
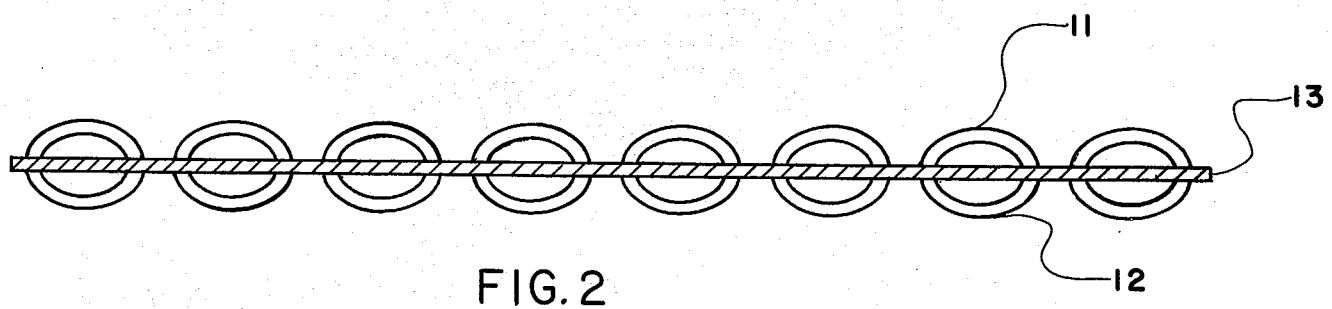
FIG. 2 is a cross-sectional view from one aspect of electrode 10 taken along the line 2—2 of FIG. 1.
Figure 3:
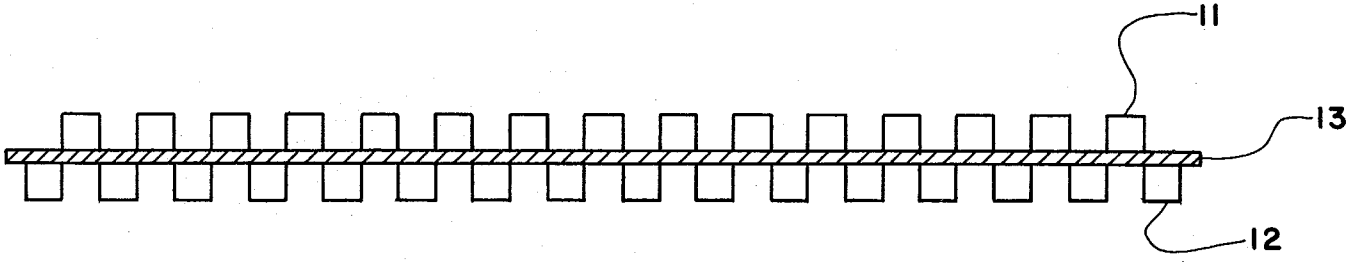
FIG. 3 is a cross-sectional view of another aspect of electrode 10 taken substantially 90 degrees from said one aspect along the line 3—3 of FIG. 1.

As will be readily apparent from comparing FIGS. 1—3 with FIGS. 4—6 and FIGS. 7—9, the 3-dimensional electrodes of this invention (FIGS. 1—3) have a geometric configuration different from both the unflattened prior art (FIGS. 4–6) and the flattened prior art (FIGS. 7–9); yet all three types are integral and can be made from expanded metal.

FIGS. 1–3 show an integral electrode having upper curved ribbon-like portions 11 and lower curved ribbon-like portions 12 both of which are symmetrical and alternate in rows between which are located substantially coplanar, substantially flat portions 13. In addition to being curved, upper portions 11 and lower portions 12 are smooth on their respective upper and lower surfaces. From FIG. 2, the curved portions 11 of electrode 10 appear separated from curved portions 12 by intermediate coplanar flat portions 13. FIG. 2 gives the appearance of a series of oblate spheroids formed by portions 11 and 12 connected by the coplanar flat portions 13. FIG. 3, however, presents the appearance of a square wave pattern alternating in sequence above and below flat portions 13.

Figure 4:
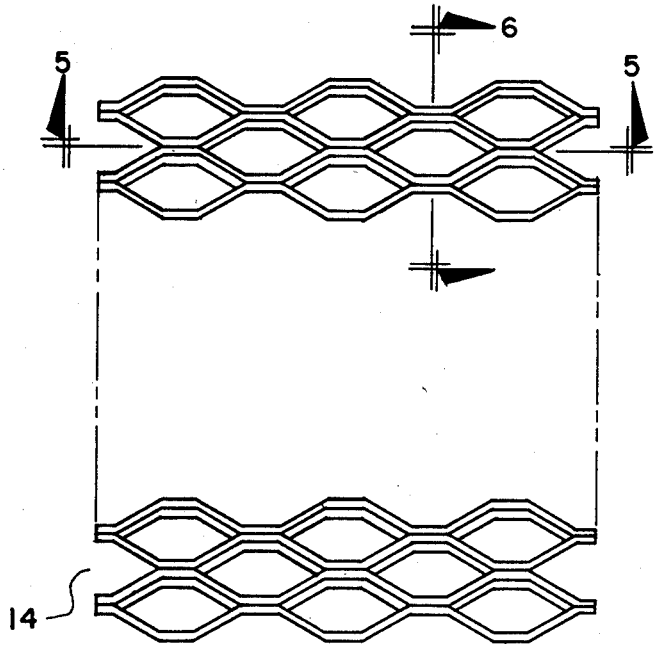
FIG. 4 is a top plan view of prior art unflattened expanded metal electrodes of elongated diamond (hexagonal) shape.
Figure 6:
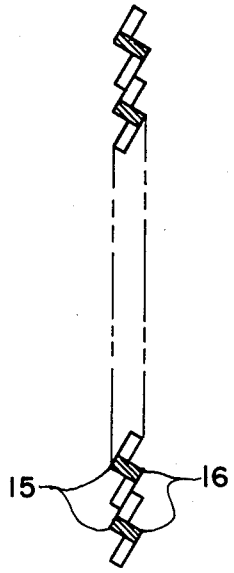
FIG. 6 is a cross-sectional view of the prior art electrode of FIG. 4 taken from another sectional aspect substantially 90 degrees from that depicted in FIG. 5 and along the line 6—6.
Figure 5:
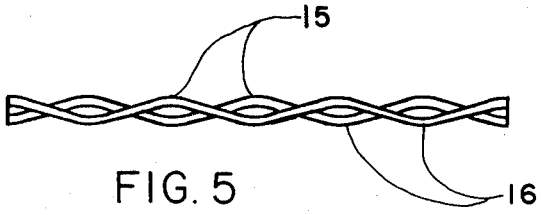
FIG. 5 is a cross-sectional view of the prior art electrode of FIG. 4 from one sectional aspect taken along lines 5—5 of FIG. 4.

In contrast thereto are the unflattened prior art electrodes of FIGS. 4–6, which show a louvered or venetian-blind appearance in one sectional aspect (FIG. 6) and a crossing sine wave pattern in another sectional aspect 90 degrees removed (FIG. 5). By comparing FIGS. 3 and 6, it will be apparent that the surfaces of upper and lower portions 11 and 12 of electrode 10 are smooth and gently curved versus the corresponding portions of the unflattened prior art electrodes 14 which are "V" shapd and have comparatively sharp upper portions 15 and lower portions 16.

Figure 7:
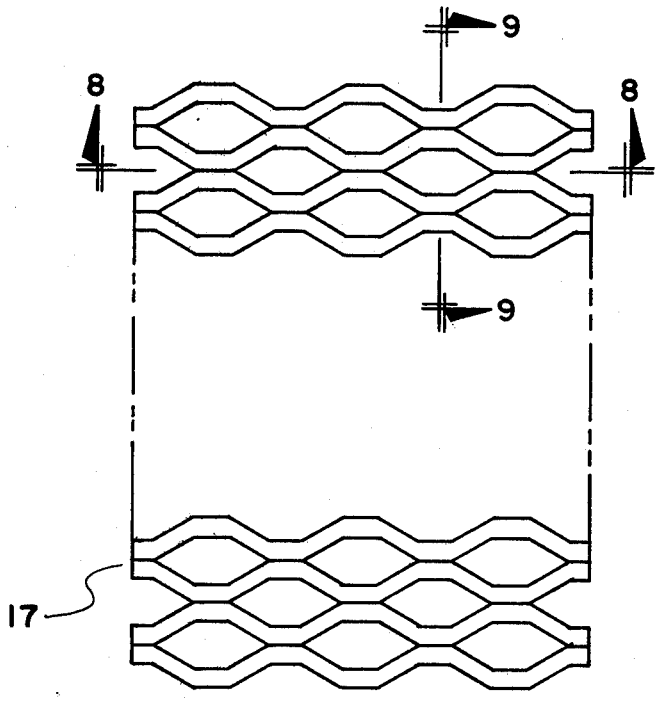
FIG. 7 is a top plan view of a prior art flattened expanded metal electrode.
Figure 9:
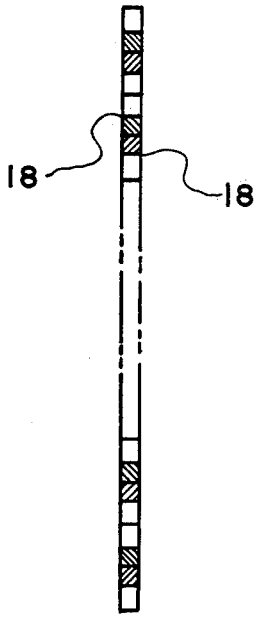
FIG. 9 is a cross-sectional view of the prior art electrode of FIG. 7 taken from another sectional aspect substantially 90 degrees from that shown in FIG. 8 along line 9—9 of FIG. 7.
Figure 8:
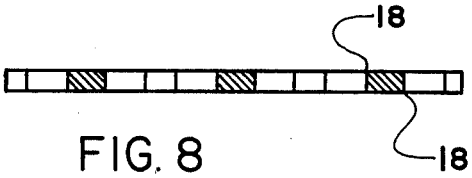
FIG. 8 is a cross-sectional view of the prior art electrode of FIG. 7 taken along line 8—8 of FIG. 7.

The flattened prior art electrodes of FIGS. 7–9 have yet another geometric configuration differing from the electrodes of this invention. As will be noted from FIGS. 8 and 9, this flattened, prior art type electrode 17 also has sharp edges 18 but of the square (90 degree) variety.

The smooth upper portions 11 and lower portions 12 of the electrodes of this invention seem to result in less difficulties in respect of tearing or rupturing of the membrane utilized in conjunction therewith. This is in contrast to the prior art unflattened expanded metal configuration, for example, as shown in FIG. 6 which will be observed to have fairly sharp upper and lower surfaces. These surfaces are pointed and of a "V" shape.

Surprisingly the electrodes of this invention when utilized in membrane, chlor-alkali cells result in a lowering in the electrical energy requirement for successful electrolytic cell operation compared with not only the electrode geometry and configuration shown in FIGS. 4–6 as representative of this type of prior art electrode, but also with the flatter expanded metal electrodes currently in use in chlor-alkali cells as indicated in FIGS. 7–9 of the drawings. The integral, 3-dimensional electrodes utilized in accordance with this invention in membrane-type chlor-alkali electrolytic cells can be used as the anode or the cathode in such cells, or said electrodes can be used as both the anode and the cathode in the same chlor-alkali cell. The distinction between whether said electrode is an anode or a cathode is the material from which it is made. For example, electrodes serving as anodes in accordance with this invention can be made from any conductive valve metal substrate, e.g., titanium, having a coating of a platinum group metal or metal oxide, e.g., platinum, ruthenium, iridium, or the equivalent. On the other hand, when the integral 3-dimensional electrode having the geometry set forth herein is to be employed as a cathode, it can be formed typically from corrosion-resistant, conductive materials such as carbon-steel (mild steel); stainless steel; nickel; nickel-plated copper; catalyzed cathodes, e.g., Raney nickel-coated steel; etc.

The electrodes of this invention are presently sold as panels for construction use under the trade designation "REGENT" by EPCO (ERDLE Perforating Co., Inc). That such panels would constitute a highly desirable geometric configuration for electrodes in membrane chlor-alkali cells is very surprising.

The electrolytic process for forming chlorine and caustic soda in a membrane-type cell utilizing the electrodes having the geometry set forth and described herein has resulted in lower operating cell voltages apparently by providing a more uniform current distribution through the membrane and on the electrode(s).

TABLE 1

| Cell | Anode Geometry | Cathode Geometry | Electrode Gap (in.) | *Temp. (°C.) | *Caustic Conc. (grams/liter) | *Caustic Current Efficiency (%) | *Cell Voltage (Volts) |
|---|---|---|---|---|---|---|---|
| 1 | ½" SWD unflattened expanded metal | ½" SWD unflattened expanded metal | 0.12 | 73 | 320 | 92.3 | 4.46 |
| 2 | "Regent" (present invention) | ½" SWD unflattened expanded metal | 0.12 | 74 | 330 | 92.4 | 4.44 |

* = Average values for the first five (5) days on line.
SWD = Short width diameter.

The above advantage of reducing electric power required to conduct the electrolytic reaction has been obtained without sacrificing the production of chlorine and caustic and while maintaining good gas release from between the membrane and said electrode(s).

The invention will be set forth in additional detal in the examples which follow. In the examples, all parts, percents and ratios are by weight unless otherwise indicated.

EXAMPLE 1

This example involved comparative testing of unflattened, expanded metal electrodes of laboratory dimensions, viz., approximately 5 inches long by 5 inches wide in a lab sized chlor-alkali test cells containing 25 square inch membranes of the "NAFION" type. The membranes were 7 mil thick "NAFION" whose outer 1.5 mils were modified with ethylene diamine, and the membranes had an equivalent weight of 1200 and a woven "Teflon®" (polytetrafluoroethylene) backing (1.5 EDA/7-1200/T-12). Both the titanium anode pan and mild steel cathode pans were flanged. The anolyte and catholyte chambers each measured approximately 6 inches by 6 inches and gaskets of conventional type were used on either side of said membranes.

The aqueous brine feed was made with deionized water. The brine pH ranged from approximately 1 to 3 and contained less than a total of one part per million of calcium and magnesium and from 200 to 300 milligrams per liter of phosphoric acid as a chelating agent for Ca and Mg. As such, the brine represented a typical brine feed to a chlor-alkali cell. The brine feed was 0.5 ml/amp min. (300 grams per liter NaCl), and the cells were operated at a current density of 2 amps/in$^2$ (3.1 kiloamps per square meter). The respective anode and cathode geometry and other pertinent observations are tabulated below.

EXAMPLE 2

This example utilized the same laboratory test cells (25 in$^2$ membranes) as in Example 1. The same test conditions, electrode gap, brine feed rate and current density were utilized as in Example 1. The electrode of this invention was used in cell 4 as the cathode. The pertinent data are presented in Table 2 below.

TABLE 2

| Cell | Anode Geometry | Cathode Geometry | *Temp. (°C.) | *Caustic Conc. (grams/liter) | *Caustic Current Efficiency (%) | *Cell Voltage (Volts) |
|---|---|---|---|---|---|---|
| 3 | ½" SWD unflattened expanded metal | ½" SWD unflattened expanded metal | 73 | 320 | 92.3 | 4.46 |
| 4 | ½" SWD unflattened expanded metal | "Regent" (present invention) | 74 | 313 | 91.9 | 4.26 |

* = Average values for the first five (5) days on line.

A 200 mV savings was obtained using the "Regent" configuration electrode in accordance with this invention.

EXAMPLE 3

This example utilized the same (25 in$^2$) laboratory sized test cells and modified "NAFION" membrane as in Example 2 and the cell is operated at the same test conditions, electrode gap, brine feed rate and current density as set forth therein. However, cell 6 used the electrode configuration of this invention for both anode and cathode. The pertinent test results are shown in Table 3.

TABLE 3

| Cell | Anode Geometry | Cathode Geometry | Temp. (°C.) | Caustic Conc. (grams/liter) | Caustic Current Efficiency (%) | Cell Voltage (Volts) |
|---|---|---|---|---|---|---|
| 5 | ½" SWD unflattened expanded metal | ½" SWD unflattened expanded metal | 73* | 320* | 92.3* | 4.46 |
| 6 | "Regent" (present | "Regent" (present | 67** | 357** | 94.3** | 4.21 |

TABLE 3-continued

| Cell | Anode Geometry | Cathode Geometry | Temp. (°C.) | Caustic Conc. (grams/liter) | Caustic Current Efficiency (%) | Cell Voltage (Volts) |
|---|---|---|---|---|---|---|
| | invention) | invention) | | | | |

* = Average values for the first five (5) days on line.
** = Average values for the first four (4) days on line.

A 250 mV savings was obtained using the electrodes of this invention as both cell anode and cell cathode.

EXAMPLE 4

This example employed the same 25 in$^2$ laboratory test cell and modified "NAFION" membrane as in Example 1 and was operated at the same current density and brine feed rate as in Example 1. However, a substantially zero electrode gap was used and the "Regent" electrodes having the "Regent" geometric configuration of the present invention (FIGS. 1 to 3) were used for both the anode and cathode. The expression "zero gap" means that both the anode and cathode touches the membrane but did not puncture it, resulting in a gap (distance) between electrodes and membrane of approximately zero (0) inch. The test data are presented below and represent the average of the first five days on line.

TABLE 4

| Cell | Temp (°C.) | Caustic Conc. (g./l.) | Caustic Current Efficiency (%) | Cell Voltage (Volts) |
|---|---|---|---|---|
| 7 | 67 | 331 | 94.2 | 4.15 |

Compared with the prior art (cell 5 of Example 3) unflattened expanded metal electrodes using a gap of approximately one-eigth inch, the electrodes of this invention resulted in approximately a 300 mV savings.

EXAMPLE 5

This example used full sized (one meter by one meter) chlor-alkali cells having one square meter modified "NAFION" cells whose outer 1.2 mils were modified with ethylene diamine, an equivalent weight of 1150, a total thickness of 7 mils and a woven polytetrafluoroethylene backing. Essentially the same brine feed was employed as in EXAMPLE 1 and an electrode gap of approximately 0.12 inch was used. The cells were operated at a cell current of 3.1 kiloamps/M$^2$ and the caustic concentration was 28 percent. Similar operating conditions were employed in this test as were used in Example 1. One cell (cell 8) contained one meter by one meter ½" SWD unflattened expanded metal anode and cathode of the prior art type illustrated in FIGS. 4–6 and another cell (cell 9) contained one meter by one meter "Regent" anode and cathode in accordance with the present invention as illustrated in FIGS. 1–3. The test results are set forth in Table 5.

TABLE 5

| Cell | Anode Geometry | Cathode Geometry | Current Efficiency (%) | Cell Voltage (Volts) |
|---|---|---|---|---|
| 8 | ½" SWD unflattened expanded metal | ½" SWD unflattened expanded metal | 94.9 | 4.07 |
| 9 | "Regent" (present invention) | "Regent" (present invention) | 94.0 | 3.91 |

As noted from Table 5, the electrodes of this invention resulted in a savings of 160 mV.

EXAMPLE 6

The test conditions of Example 5 were repeated using the same modified "NAFION" membrane, the same sized cells, membranes, anodes and cathodes as in Example 5. All three test cells in this example were operated at 77° C. using the same electrode gap, current density, caustic concentration and other operating conditions as in Example 5. The test data are set forth in Table 6.

TABLE 6

| Cell | Anode Geometry | Cathode Geometry | Initial Cell Voltage (Volts) | Millivolt Savings |
|---|---|---|---|---|
| 10 | ½" SWD unflattened expanded metal | ½" SWD unflattened expanded metal | 3.84 | — |
| 11 | ½" SWD unflattened expanded metal | "Regent" (present invention) | 3.65 | 190 |
| 12 | "Regent" (present invention) | "Regent" (present invention) | 3.70 | 140 |

I claim:

1. In a membrane-type chlor-alkali cell utilizing electrodes the improvement comprising: at least one of said electrodes being an integral, three-dimensional electrode having a substantially planar sheet-like portion and rows of curved portions protruding therefrom; produced by a forming means; from at least part of said planar sheet-like portion; said rows alternating said protruding curved portions above and below the surface of said substantially planar sheet-like portion; said three-dimensional electrode thereby having a geometric configuration offering in one sectional aspect the appearance of a series of oblate spheroids interrupted by said planar sheet-like portion and another sectional aspect, 90° from said one aspect, the appearance of a square wave pattern; said sections being taken through the plane of the planar sheet-like portion.

2. In a membrane-type chlor-alkali cell as claimed in claim 1, wherein said integral, three-dimensional electrode is utilized as the anode.

3. In a membrane-type chlor-alkali cell as claimed in claim 1, wherein said integral three-dimensional electrode is utilized as the cathode.

4. In a membrane-type chlor-alkali cell as claimed in claim 1, wherein one said integral, three-dimensional electrode is utilized for the anode and another integral, three-dimensional electrode is utilized for the cathode.

5. In a process for electrochemically producing chlorine and caustic soda by passing current through a brine solution in an electrolytic membrane-type cell the improvement comprising utilizing at least one integral, three-dimensional electrode having a substantially planar sheet-like portion and rows of curved portions protruding therefrom; said rows alternating said protruding curved portions above and below the surface of said substantial planar sheet-like portions; said three-dimensional electrode thereby having a geometric configuration offering in one sectional aspect the appearance of a series of oblate spheroids interruped by said planar sheet-like portion and in another sectional aspect, 90° from said one aspect, the appearance of a square wave pattern; said sections being taken through the plane of the planar sheet-like portion.

6. In a process as claimed in claim 5, wherein said integral three-dimensional electrode is utilized as the anode in said cell.

7. In a process for electrochemically producing chlorine and caustic soda as claimed in claim 5, wherein said integral three-dimensional electrode is utilized as the cathode of said cell.

8. In the process as claimed in claim 5, wherein one said integral, three-dimensional electrode is utilized for the anode and another integral three-dimensional electrode is utilized for the cathode of said cell.

* * * * *